United States Patent [19]

Weinstein

[11] Patent Number: 4,512,788

[45] Date of Patent: Apr. 23, 1985

[54] TOP LOADING UPRIGHT VACUUM CLEANER BAG AND METHOD OF MANUFACTURING THE SAME

[75] Inventor: Raymond P. Weinstein, Raleigh, N.C.

[73] Assignee: Home Care Industries, Inc., Oxford, N.C.

[21] Appl. No.: 529,568

[22] Filed: Sep. 6, 1983

[51] Int. Cl.[3] ..... B01D 46/02

[52] U.S. Cl. ..... 55/374; 55/381; 493/924; 493/929; 156/198; 156/252; 156/291; 383/66; 383/123; 383/904

[58] Field of Search ..... 55/368, 374–377, 55/381, 382; 493/189, 213, 214, 215, 266, 267, 493/924, 929; 383/904, 66, 123; 156/198, 252, 291

[56] References Cited

U.S. PATENT DOCUMENTS

| | | | |
|---|---|---|---|
| 2,239,133 | 4/1941 | Waters | 493/189 |
| 2,995,205 | 8/1961 | Cordell | 383/904 |
| 3,333,523 | 8/1967 | Terzuoli | 493/266 |
| 3,491,522 | 1/1970 | Fesco | 55/376 |
| 3,619,989 | 11/1971 | Howard et al. | 55/368 |
| 4,155,727 | 5/1979 | Kaulig | 55/381 |
| 4,322,259 | 3/1982 | Fesco | 55/381 |

FOREIGN PATENT DOCUMENTS

| | | | |
|---|---|---|---|
| 567484 | 2/1945 | United Kingdom | 383/123 |

*Primary Examiner*—Bernard Nozick

*Attorney, Agent, or Firm*—Parmelee, Miller, Welsh & Kratz

[57] ABSTRACT

A vacuum cleaner bag for use with top loading vacuum cleaner has a first collection tube and a second transfer tube, the tubes having communicating apertures near the top thereof, with a thermoplastic coating on the inner walls of the second transfer tube which is fused together to seal the second transfer tube adjacent the lower wall of the aperture thereof, the top and bottom of the first tube and bottom of the second transfer tube adhesively sealed; and a method for automatically forming the bags by superimposing the two tubes, adhesively securing them together, heat sealing the inner walls of the second transfer tube together, below the aperture, and closing the ends of the tubes.

19 Claims, 9 Drawing Figures

TOP LOADING UPRIGHT VACUUM CLEANER BAG AND METHOD OF MANUFACTURING THE SAME

BACKGROUND OF THE INVENTION

This invention relates to a disposable vacuum cleaner bag for use with top loading upright vacuum cleaners and a fully automated method for forming such bags.

Disposable vacuum cleaner bags have been made which are comprised of a tube portion which leads air and collected dust into another larger air pervious tube, or collection chamber. The tube portion may be made from an air pervious or air impervious material, while the collection chamber is of an air pervious material. These bags are inserted into a cloth, vinyl, felt or other outer bag attached to a sweeper tank and, when full, the inner bag may be disposed of without dust problems associated with cleaners which do not use disposable bags.

Many upright cleaners which use such disposable bags are of a bottom loading design. Such bottom loading cleaners are disadvantageous in that the cleaner must force its air stream upwardly through previously collected dirt in the bag. In order to alleviate the problem, somewhat, with the bottom loading cleaners, vacuum cleaner bags have been developed which connect a transfer tube to the cleaner at a bottom connection, which transfer tube leads to a main collection bag compartment where the dirt is fed near the top and falls to the bottom of the collection compartment.

In U.S. Pat. No. 3,322,041, for example, a bottom connection, but top loading design is shown, wherein the two sections are attached together only along the apertures which are formed in the two sections for passage of air flow from the transfer chamber to an air pervious or dust collection section. Such a design is an improvement over bottom loading designs because a cleaner air stream does not have to flow through previously collected dirt. Prevalent top loading, but bottom connection, bag designs have a transfer tube which attaches to the dirt inlet duct of the vacuum cleaner near the bottom of the cleaner. The dirty air stream then blows up the transfer tube and through a window area between the transfer tube and the collection bag and then falls down into the collection bag. There are, however, two fundamental problems associated with such a bag design. One is that there is a tendency for the flexible duct member in the cleaner itself to collapse and cause clogging; and, secondly, it is possible for the consumer to improperly attach the bag to the cleaner. Indeed, this occurs often and results in bag failure and cleaner malfunction. The improper attachment occurs when the consumer folds the transfer tube into a U-shape before installing the bag, thus placing the bag, into the carrier, upside down.

In an attempt to overcome these problems associated with a bottom connection but top loading bag, cleaners have been designed which are top loading and top connection cleaners. Bags designed for use with such top loading cleaners overcame the above described problems, but also have caused problems of their own. Such bags require a transfer tube which attaches to the cleaner inlet duct and leads from the top of the bag to the cooperating apertures in the transfer tube and another section or collection bag. In order to produce the bags on fully automated equipment, the transfer tube must extend the full length of the collection bag. Since the window is near the top of the transfer tube, the entire lower section of the transfer tube would pack with dirt before dirt would flow through the window into the collection bag. In order to overcome this problem, the use of a short closed end bag or transfer tube was proposed, in combination with the collection bag, with the closed end bag having a hole in one wall communicating with the aperture in the wall of the collection bag. Use of such short bags, however, still left a small pocket below the windows which would fill with dirt. A further problem with such a short bag transfer tube—collection bag combination, however, is that such a configuration requires three separate production operations. In one operation, the main bag body or collection bag is produced on one machine; in a second operation, the transfer tube or short bag section is produced on a second machine; and, in a third operation, the collection bag and the transfer tube, or short bag, are joined together on a third machine. The additional waste of these multiple operations, coupled with low production rates and numerous handling operations, make such a composite bag design expensive to produce and limits its availability.

It is an object of the present invention to provide a novel vacuum cleaner bag for use with top loading upright vacuum cleaners.

It is another object of this present invention to provide a fully automated method for producing vacuum cleaner bags for use with top loading upright vacuum cleaners.

SUMMARY OF THE INVENTION

A vacuum cleaner bag for use with top loading upright vacuum cleaners comprises a first collection tube having closed ends and an aperture in a wall thereof, near the top of the collection tube, to serve as a collection bag, and a second narrower transfer tube having an aperture communicating with the aperture of the first collection tube, serving as a feed tube. The second transfer tube has an open top end and a coating of thermoplastic material along the inner wall, at least adjacent the lower end of the aperture therein, and preferably completely over the inner wall, and a seal is formed between the inner walls of the second transfer tube by fusion of the thermoplastic material immediately below the aperture. The second transfer tube preferably extends the full length of the first collection tube and the bottom of the second transfer tube is closed with the bottom of the first collection tube to form a common closed end.

The bags are formed on automated equipment by bringing the first and second tubes together, with the apertures aligned with each other, adhesively securing the tubes together and sealing the second tube, which has the inner coating of thermoplastic material, immediately below the aperture therein by application of heat and pressure to fuse the thermoplastic coating together. The top of the first tube is then adhesively closed by folding, and the bottom of the first and second tube preferably closed together by applying adhesive and folding of the same.

DETAILED DESCRIPTION

Figure 1:
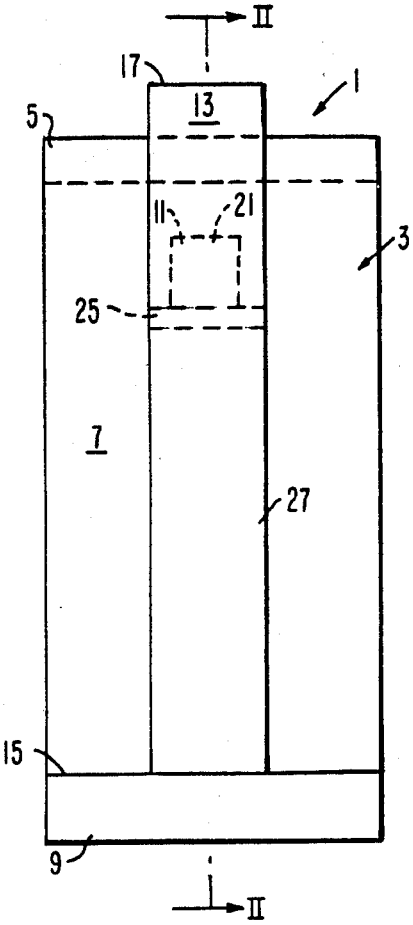
FIG. 1 is a plan view of a vacuum cleaner bag, for use with top loading upright vacuum cleaners, prepared according to the present invention.
Figure 2:
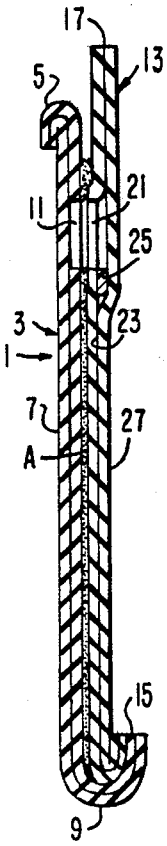
FIG. 2 is a cross-sectional view taken along lines II—II of FIG. 1.
Figure 3:
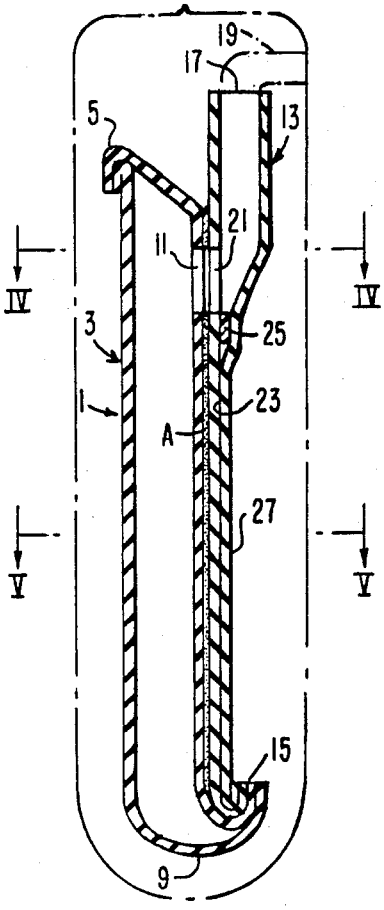
FIG. 3 is a view similar to that of FIG. 2 showing the bag in expanded position and within a cover bag of a cleaner, shown in phantom.
Figure 4:
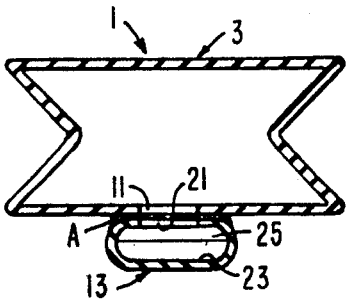
FIG. 4 is a cross-sectional view taken along lines IV—IV of FIG. 3.
Figure 5:
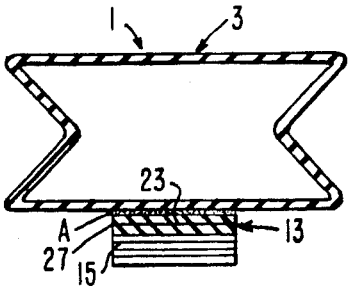
FIG. 5 is a cross-sectional view taken along the lines V—V of FIG. 3.

Referring now to the drawings, the vacuum cleaner bag and its method of manufacture, are illustrated.

The present bag 1, for use with top loading upright vacuum cleaners, has a first tube or collection bag 3 which is formed from an air pervious material, such as are conventional paper vacuum cleaner bags. The collection bag 3 has a closed top 5, middle body portion 7 and a closed bottom 9, with an aperture or window 11, formed in a wall of the collection bag 3 near the top 5.

A second transfer tube or feed tube 13 is formed from an air impervious or an air pervious material and is attached to the first tube 3, along the tube such as by adhesive A. The material from which the second transfer tube is formed may be an air pervious material such as a vacuum cleaner filter paper, or an air impervious material, such as a Kraft paper material, or the like. The second transfer tube 13, which has a narrower width than the first collection tube 3, has a closed bottom end 15 and an open top end 17, which top end extends beyond the top 5 of first collection tube 3, and is attachable to the air exhaust line 19 of a top loading upright vacuum cleaner (not shown). The closed bottom end 9 of the first collection tube and closed bottom end 15 of the second transfer tube are preferably closed together by folding, as illustrated, with adhesive applied. Other folding and adhesive configurations or other sealing methods may be used, for example sealing by sewing, stapling, taping, or the like. The second transfer tube 13 has an aperture or window 21 in a wall thereof which communicates with the aperture 11 of first collection tube 3. The second transfer tube 13 has, on the inner wall thereof, a thermoplastic material or coating 23. The thermoplastic material is preferably a coating over the complete inner wall, or it may be a strip or section of thermoplastic material on the inner wall which is positioned, relative to the transfer tube 13, adjacent the lower edge of the aperture 21. At the location adjacent the lower edge of the aperture 21, the thermoplastic coating of the inner wall of transfer tube 13, is fused together to form a seal 25. In the drawings, the seal 25 is exaggerated in size to show its position, while in actuality, the seal formed by the fused coating is not any larger than the thickness of the coatings. The seal 25 prevents air and dirt, entering the transfer tube 13 through open end 17, from entering the tube portion 27 below the seal and directs all air and dirt from the transfer tube 13 through apertures 21 and 11 into the collection bag or first collection tube 3.

The second transfer tube 13 is formed from a material such as heavy paper having a thermoplastic coating on one side, which is then folded to form a tube with the thermoplastic coating on the inside wall of the tube. The thermoplastic coating is preferably a polyethylene coating, although other thermoplastics, such as a hot melt adhesive, may be used, provided the coating on the inner wall of the tube will fuse together under heat and pressure, without adversely affecting the rest of the tubes 3 and 13, to provide the seal 25. In the preferred embodiment illustrated, the thermoplastic coating completely covers the inner wall of the second transfer tube 13, although it is understood that the coating only need be completely around the inner wall of the second tube at the area below and adjacent to the lower edge of aperture 21, where the fusion is to be affected to form seal 25. Also, as illustrated in the preferred embodiment, the second transfer tube 13 preferably extends the entire length of the first collection tube 3 such that closing of the bottom of both tubes may be effected in one closure step, and the complete bag may be formed on totally automated equipment. It is also possible to have the bottom end of the second transfer tube 13 extend only to a location spaced from the bottom end 9 of the first collection tube 3, provided the seal 25 is still formed completely across the second transfer tube 13 at the location adjacent the lower edge of aperture 21.

Figure 6:
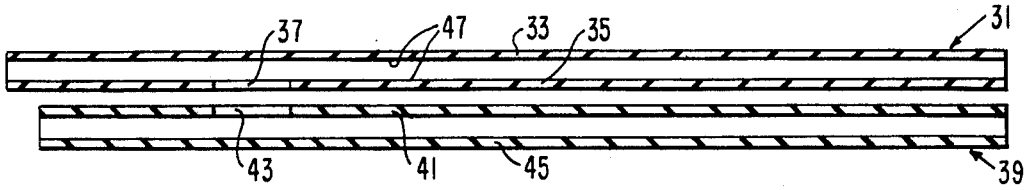
FIG. 6 is a cross-sectional view taken along the center line along the length of two tubes being superimposed in forming a bag according to the present method.
Figure 7:
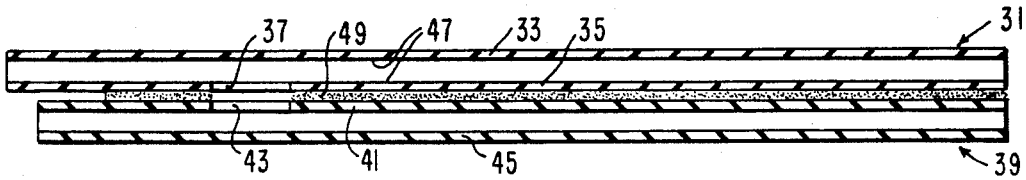
FIG. 7 is a view similar to FIG. 6 showing the two tubes being adhesively secured together.

In the fully automated method for forming the bags according to the present invention, reference is made to FIGS. 6 through 9. As illustrated in FIG. 6, a second tube 31, of air pervious or air impervious material, having a top wall 33 and bottom wall 35 with an aperture 37 formed in the bottom wall, is superimposed over a first tube 39 of air pervious material, the first tube having a top wall 41, with an aperture 43 formed therein, and a bottom wall 45. The tubes are positioned such that the aperture 37 in the bottom wall 35 of the second tube 31 overlies the aperture 43 of the top wall 41 of the first tube 39. The tube 31 has a coating of a thermoplastic material 47, such as polyethylene, along the inner surface of both top wall 33 and bottom wall 35. The two tubes 31 and 39 are then adhesively secured together by application of adhesive 49 to either the outer surface of top wall 41 or the outer surface of the bottom wall 35, or both, and the two tubes pressed together as illustrated in FIG. 7. While the adhesive is shown to extend the full length of the tubes, it is understood that such adhesive need only be present about the apertures to secure the tubes together and effect communication between the two tubes through the apertures.

Figure 8:
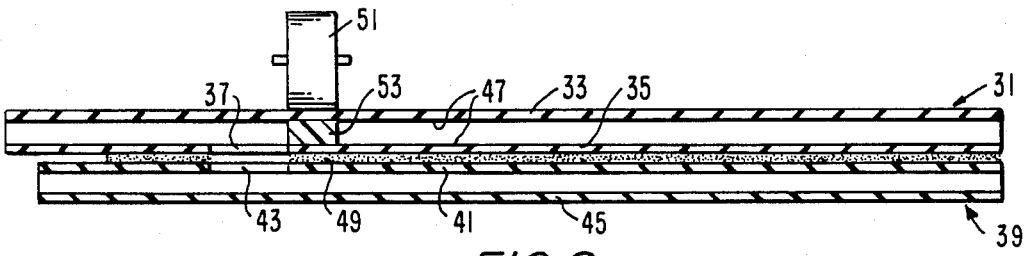
FIG. 8 is a view similar to FIG. 6 showing formation of the seal by fusion of the thermoplastic coating on the inner wall of the second tube.
Figure 9:
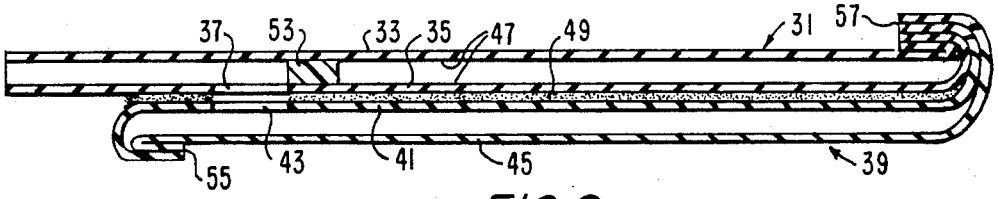
FIG. 9 illustrates the closing of the top end of the first tube and the bottom ends of both tubes in the formation of the bag of the present invention.

When the two tubes 31 and 39 have been adhesively secured together, with apertures 37 and 43 communicating with each other, heat and pressure are applied to the second tube at a location adjacent the lower edge of the aperture 37. As illustrated in FIG. 8, the heat and pressure may be applied by a hot roller 51, or a heated bar or other means, such that the thermoplastic material will soften and fuse together to form a seal 53 across the second tube immediately below the aperture 37. Again, the fused material is shown in exaggerated size to indicate its location, but will only be a fusion of the coating of the walls, sealing the walls together.

After formation of the heat seal 53, the top end of the first tube 39 is folded over upon itself, as at 55, preferably with a double fold and adhesively secured together to form the closed top of the first tube or collection bag 39. The bottom end of both tubes 39 and 31 are then also folded over, as at 57 and adhesively secured together to form a closed end for both the first tube 39 and second transfer tube 31.

What is claimed is:

1. In a vacuum cleaner bag having a first collection tube of air pervious filter material having a closed top and a closed bottom and an aperture through one wall near the top thereof, and a second transfer tube having an open top and a narrower width than the first collection tube and an aperture in a wall thereof which cooperates with the aperture in the first collection tube, said first and second tubes adhesively secured together about the cooperating apertures, with the second transfer tube extending below said cooperating apertures, wherein said vacuum cleaner bag is for use with a top loading upright vacuum cleaner; the improvement wherein said second transfer tube has a thermoplastic coating within said tube around the inner walls thereof at least at the portion thereof adjacent the lower edge of the aperture therein and extending across said second transfer tube, and the inner walls of the second transfer tube are sealed together by fusion of said thermoplastic material at a location adjacent the lower edge of said aperture.

2. A vacuum cleaner filter bag as defined in claim 1 wherein the coating of thermoplastic material covers the entire inner walls of the second transfer tube.

3. A vacuum cleaner filter bag defined in claim 1 wherein the open top end of the second transfer tube extends beyond the closed top end of the first collection tube.

4. A vacuum cleaner filter bag as defined in claim 1 wherein said thermoplastic coating is polyethylene.

5. A vacuum cleaner filter bag as defined in claim 1 wherein said second transfer tube is formed from an air pervious material.

6. A vacuum cleaner filter bag as defined in claim 1 wherein said second transfer tube is formed from an air impervious material.

7. A vacuum cleaner filter bag as defined in claim 1 wherein the second transfer tube extends the complete length of the first collection tube.

8. A vacuum cleaner filter bag as defined in claim 7 wherein the bottom edge of the first collection tube and bottom edge of the second transfer tube are sealed together by folding, and adhesively secured to close the bottom of both tubes.

9. In a vacuum cleaner bag having a first collection tube of air pervious material having a closed top and closed bottom and an aperture through a wall thereof near the top of the tube, and a second transfer tube having a narrower width than the first collection tube and extending the length of the first collection tube, the second transfer tube having an open end and an aperture in a wall thereof cooperating with the aperture in the first collection tube, said first and second tubes adhesively secured about the cooperating apertures wherein said vacuum cleaner bag is for use with a top loading upright vacuum cleaner; the improvement wherein said second transfer tube has a thermoplastic coating within the tube, covering the inner walls thereof, with the inner walls of the second transfer tube being sealed together by fusion of said thermoplastic coating at a location adjacent the lower edge of said aperture extending across said second transfer tube, and the lower end of the second transfer tube is closed together with the closed bottom of the first collection tube.

10. A vacuum cleaner filter bag as defined in claim 9 wherein said thermoplastic coating is polyethylene.

11. A method for forming a vacuum cleaner filter bag for use with a top loading upright vacuum cleaner, comprising:

adhesively securing together a first tube of air pervious material and a second tube, each of said tubes having an aperture in a wall thereof which cooperates with an aperture in the wall of the other tube, said adhesively securing together of the tubes being at least about said cooperating apertures, the second tube extending the complete length of the first tube and having a thermoplastic coating, within the tube, covering the inner walls thereof, and extending across the tube;

heating the second tube in the area of the tube adjacent the lower edge of the aperture, under pressure, to seal the inner walls of the second tube together;

adhesively sealing the top portion of the first tube; and adhesively sealing the bottom portions of the first and second tubes together to close the same.

12. The method of forming a vacuum cleaner filter bag as defined in claim 11 wherein said thermoplastic coating is polyethylene.

13. A method for forming a vacuum cleaner filter bag for use with a top loading upright vacuum cleaner, comprising:

adhesively securing together a first tube of air pervious material and a second tube, each of said tubes having an aperture in a wall thereof which cooperates with an aperture in the wall of the other tube, said adhesively securing together of the tubes being at least about said cooperating aperture, the second tube having a thermoplastic coating, within the tube, on the inner walls thereof, at least at the portion thereof adjacent the lower edge of the aperture therein and extending across the tube;

heating the second tube in the area of the thermoplastic coating, adjacent the lower edge of the aperture, under pressure, to seal the inner walls of the second tube together;

sealing the top portion of the first tube; and sealing the bottom portion of the first tube.

14. The method for forming a vacuum cleaner filter bag as defined in claim 13 wherein the thermoplastic coating completely covers the inner walls of the second tube.

15. The method for forming a vacuum cleaner filter bag as defined in claim 13 wherein said thermoplastic coating is polyethylene.

16. The method for forming a vacuum cleaner filter bag as defined in claim 13 wherein said sealing of the top portion of the first tube and the bottom portion of the second tube is by adhesively sealing the same.

17. The method of forming a vacuum cleaner filter bag as defined in claim 13 wherein the second tube extends the complete length of the first tube.

18. The method of forming a vacuum cleaner filter bag as defined in claim 17 wherein said sealing of the top portion of the first tube and the bottom portion of the second tube is by adhesively sealing the same.

19. The method of forming a vacuum cleaner filter bag as defined in claim 18 wherein the bottom portion of the second tube is adhesively sealed with the bottom portion of the first tube to close both tubes.

* * * * *